US010808455B2

(12) United States Patent
Hebeisen et al.

(10) Patent No.: US 10,808,455 B2
(45) Date of Patent: Oct. 20, 2020

(54) WIRED POCKET WITH LIGHTING

(71) Applicant: Mechoshade Systems, LLC, Middleton, WI (US)

(72) Inventors: Stephen P. Hebeisen, Amawalk, NY (US); Xi Ming Liarno, Brooklyn, NY (US); Eugene Miroshnichenko, Oceanside, NY (US)

(73) Assignee: MECHOSHADE SYSTEMS, LLC, Middleton, WI (US)

( * ) Notice: Subject to any disclaimer, the term of this patent is extended or adjusted under 35 U.S.C. 154(b) by 0 days.

(21) Appl. No.: 16/728,339

(22) Filed: Dec. 27, 2019

(65) Prior Publication Data

US 2020/0131846 A1 Apr. 30, 2020

Related U.S. Application Data

(63) Continuation-in-part of application No. 15/334,591, filed on Oct. 26, 2016, now Pat. No. 10,544,622.

(Continued)

(51) Int. Cl.

*E06B 9/17* (2006.01)
*F21V 33/00* (2006.01)

(Continued)

(52) U.S. Cl.

CPC ..... *E06B 9/17007* (2013.01); *E06B 9/42* (2013.01); *E06B 9/56* (2013.01); *F21V 33/006* (2013.01);

(Continued)

(58) Field of Classification Search

None

See application file for complete search history.

(56) References Cited

U.S. PATENT DOCUMENTS 3,007,036 A ‡ 10/1961 Mills, Jr. ..... F21V 17/104 160/38
3,271,568 A * 9/1966 Lundberg ..... F21V 33/0016 40/545

(Continued)

FOREIGN PATENT DOCUMENTS

AT 399200 3/1995
AT 399200 B ‡ 3/1995

(Continued)

OTHER PUBLICATIONS

Examination Report dated Jul. 6, 2017 in GB Application No. GB1618179.4.‡

(Continued)

*Primary Examiner* — Robert Canfield
(74) *Attorney, Agent, or Firm* — Snell & Wilmer L.L.P.

(57) ABSTRACT

The window shade pocket system may comprise a pocket having an inside surface, a first wall and a second wall, wherein a roller shade is mounted within the pocket; and a first bracket removably affixed to the inside surface of the first wall of the pocket, wherein the first bracket retains a light source. The light source may include at least one of a light bulb, light bar, light strip, LED lighting or reflective device. The light source may be LED lighting that is modular or provides different colors over the window shade fabric. The light source may include a lens. The light source may be at least one of removeable from the first bracket or rotatable within the first bracket. The light source may be at least one of between the window shade and the window, or between the room and the window shade.

20 Claims, 11 Drawing Sheets

Related U.S. Application Data

(60) Provisional application No. 62/247,036, filed on Oct. 27, 2015.

(51) Int. Cl.

| | |
|---|---|
| ***E06B 9/42*** | (2006.01) |
| ***E06B 9/56*** | (2006.01) |
| *F21Y 115/10* | (2016.01) |
| *E06B 9/24* | (2006.01) |

(52) U.S. Cl.

CPC ..... *E06B 2009/247* (2013.01); *F21Y 2115/10* (2016.08); *Y10S 362/00* (2013.01)

(56) References Cited

U.S. PATENT DOCUMENTS

| | | | | |
|---|---|---|---|---|
| 4,060,310 | A ‡ | 11/1977 | Brown | G03B 21/58 160/310 |
| 4,156,270 | A ‡ | 5/1979 | Beatty | F21V 17/04 362/145 |
| 4,169,658 | A ‡ | 10/1979 | Brown | G03B 21/58 352/36 |
| 4,254,813 | A ‡ | 3/1981 | Vecchiarelli | A47H 2/00 160/19 |
| 4,404,770 | A ‡ | 9/1983 | Markus | E05D 15/1021 49/235 |
| 4,753,025 | A ‡ | 6/1988 | Wennstrom | G06F 11/025 40/470 |
| 5,046,380 | A ‡ | 9/1991 | Matsumoto | F16C 1/105 74/502.4 |
| 5,067,540 | A ‡ | 11/1991 | Besler | E06B 9/17023 160/23.1 |
| 5,121,782 | A ‡ | 6/1992 | Renkhoff | E04F 10/0618 160/22 |
| 5,148,849 | A * | 9/1992 | Faludy | B60P 3/343 160/10 |
| 5,296,964 | A ‡ | 3/1994 | Shopp | G03B 21/58 160/19 |
| 5,413,161 | A * | 5/1995 | Corazzini | E06B 9/32 160/168.1 P |
| 6,111,694 | A ‡ | 8/2000 | Shopp | G03B 21/58 160/23.1 |
| 6,230,782 | B1 ‡ | 5/2001 | Reichert | E06B 9/17023 160/23.1 |
| 6,253,492 | B1 ‡ | 7/2001 | Finke | E05D 1/06 16/87.4 R |
| 6,388,404 | B1 * | 5/2002 | Schnebly | E06B 9/32 318/16 |
| 6,410,908 | B1 ‡ | 6/2002 | Anderson | E06B 9/32 250/21 |
| 6,421,175 | B1 ‡ | 7/2002 | Shopp | G03B 21/58 160/31 |
| 6,446,394 | B1 ‡ | 9/2002 | Finke | E05D 15/0652 49/409 |
| 6,532,109 | B1 ‡ | 3/2003 | Shopp | G03B 21/58 160/23 |
| 6,736,186 | B2 ‡ | 5/2004 | Anderson | E06B 9/32 160/16 |
| 6,816,308 | B1 ‡ | 11/2004 | Shopp | G03B 21/58 160/23 |
| 6,873,461 | B1 ‡ | 3/2005 | McPherson, Jr. | E06B 9/50 160/23 |
| 7,559,707 | B2 ‡ | 7/2009 | Shopp | G03B 21/58 396/46 |
| 8,505,865 | B2 * | 8/2013 | Wills | E06B 9/42 248/266 |
| 8,684,062 | B2 * | 4/2014 | Ng | E06B 9/42 160/23.1 |
| 9,115,537 | B2 ‡ | 8/2015 | Blair | E06B 9/42 |
| 9,617,785 | B2 * | 4/2017 | Chou | E06B 9/24 |
| D808,684 | S * | 1/2018 | Santilli | D6/580 |
| D854,855 | S * | 7/2019 | Garcia Garcia | D6/580 |
| 2005/0205216 | A1 ‡ | 9/2005 | Vrielink | E06B 9/323 160/23.1 |
| 2008/0289775 | A1 * | 11/2008 | Lukos | E04F 10/0662 160/242 |
| 2013/0068398 | A1 ‡ | 3/2013 | Wills | E06B 9/42 160/26 |
| 2017/0114593 | A1 ‡ | 4/2017 | Hebeisen | E06B 9/17007 |
| 2017/0362827 | A1 * | 12/2017 | Geiger | A47H 1/104 |
| 2018/0106102 | A1 ‡ | 4/2018 | Holt | E06B 9/42 |
| 2018/0163465 | A1 ‡ | 6/2018 | Biedermann | E06B 9/50 |
| 2018/0202157 | A1 * | 7/2018 | Neal | E04B 9/30 |
| 2020/0063447 | A1 * | 2/2020 | Brinkman | E04B 9/30 |

FOREIGN PATENT DOCUMENTS

| | | | | |
|---|---|---|---|---|
| DE | 3806611 | | 9/1989 | |
| DE | 3806611 | A1 ‡ | 9/1989 | |
| DE | 102007059388 | A1 * | 6/2009 | E04F 10/0685 |
| DE | 102011116707 | A1 * | 4/2013 | |
| DE | 202012103629 | U1 * | 11/2013 | E06B 9/17007 |
| EP | 2602421 | A2 * | 6/2013 | E06B 9/17007 |
| EP | 2631415 | | 8/2013 | |
| EP | 2631415 | A2 ‡ | 8/2013 | |
| EP | 2843178 | | 8/2013 | |
| EP | 2843178 | B1 ‡ | 12/2016 | |
| EP | 3521543 | A1 * | 8/2019 | E06B 9/17007 |
| FR | 2845725 | A1 * | 4/2004 | E06B 9/17007 |
| FR | 2911364 | | 7/2008 | |
| FR | 2911364 | A1 ‡ | 7/2008 | |
| GB | 2542330 | | 3/2017 | |
| GB | 2542330 | A ‡ | 3/2017 | |
| JP | 2000192757 | ‡ | 7/2000 | |
| JP | 2003221987 | ‡ | 8/2003 | |
| JP | 2004076300 | ‡ | 3/2004 | |
| JP | 2014214524 | ‡ | 1/2010 | |
| JP | 2013108238 | ‡ | 6/2013 | |
| JP | 2013170441 | ‡ | 9/2013 | |
| JP | 2014234593 | ‡ | 12/2014 | |

OTHER PUBLICATIONS

Combined Search and Examination Report dated Mar. 9, 2017 in GB Application No. GB1618179.4.‡

Office Action dated Aug. 30, 2017 in Canadian Application No. 2,946,634.‡

Notice of Allowance dated Jan. 4, 2018 in Canadian Application No. 2,946,634.‡

USPTO, Restriction/Election Requirement dated Aug. 29, 2018 in U.S. Appl. No. 15/334,591.

USPTO, Non-Final Office Action dated Sep. 17, 2018 in U.S. Appl. No. 15/334,591.

USPTO, Final Office Action dated Apr. 24, 2019 in U.S. Appl. No. 15/334,591.

USPTO, Advisory Action dated May 16, 2019 in U.S. Appl. No. 15/334,591.

USPTO, Non-Final Office Action dated Jun. 13, 2019 in U.S. Appl. No. 15/334,591.

USPTO, Notice of Allowance dated Sep. 20, 2019 in U.S. Appl. No. 15/334,591.

* cited by examiner

‡ imported from a related application

WIRED POCKET WITH LIGHTING

CROSS-REFERENCE TO RELATED APPLICATIONS

This application is a continuation-in-part of, and claims priority to and the benefit of, U.S. patent application Ser. No. 15/334,591 filed on Oct. 26, 2016 and entitled "WIRED POCKET." The '591 application claims priority to, and the benefit of, U.S. Provisional Application Ser. No. 62/247,036 filed on Oct. 27, 2015 and entitled "WIRED POCKET." All of the above-identified applications are hereby incorporated by reference in their entirety for all purposes.

FIELD

The disclosure relates to window shade systems, and more particularly, to a pocket that includes a light source that can shine on a window shade.

BACKGROUND

Window shade systems typically include a pocket (or space) for mounting the shade and another pocket for housing the wiring associated with the shade and other electronics. The window shade installer must often determine where to locate each of the pockets. The locations of the pockets may be important for not only accessibility, but also to comply with certain fire codes. An important part of the decision for the pocket location is the different codes that may apply to different areas. For example, items that exist in a room may be subject to different fire codes than items that exist in the ceiling or plenum. Such codes may determine if the contractor needs to include plenum cable or non-plenum cable. The type of jacket surrounding the cable may be impacted by the location of the cable.

The plenum spaces are between a drop and standard ceiling. The plenum spaces may also similarly exist in the floor space. These spaces are where the air in a building circulates, so these spaces are used to aid in heating and cooling functions. While non-plenum (PVC) cable is less expensive, plenum cable is often required when no conduit is used in the plenum spaces. Fire and smoke travel quickly in plenum spaces. As such, the levels of toxicity in the smoke are typically lower since plenum cable includes a jacket that is often comprised of flame-resistant material (e.g., Teflon). The flame resistant material results in the cable smoking less than regular non-plenum (PVC) cable and the smoke that is emitted is less toxic. If the window shade pocket can be considered to be part of the room (and not part of the plenum), then the less expensive non-plenum cabling can be used in the pocket.

Moreover, a pocket that holds a window shade may be a very long structure. Because different pockets may need to accommodate different size shades, the pockets may vary in size. Furthermore, the pockets may include different features which may need to be incorporated into the pocket walls. The design of a pocket should take into consideration all of these features, while still being designed to be as light and inexpensive as possible.

SUMMARY

The disclosure includes a window shade pocket system comprising a pocket having an inside surface, a bracket removably affixed to the inside surface of the pocket and a roller shade within the pocket. The inside surface of the pocket may include a first wall, a second wall and a third wall, wherein the third wall includes the bracket retaining the cabling. The bracket may retain cabling and/or electrical components within the bracket. The bracket may include a plurality of brackets along the inside surface of the pocket, wherein the cabling is retained within the plurality of brackets. The brackets may form a channel between the bracket and the inside surface of the pocket. The roller shade may be able to be removed after the bracket is removed or the roller shade may be able to be removed while the bracket is still affixed to the inside surface of the pocket.

The bracket may include a bent metal retaining clip or a spring clip. The end of the bracket may be retained behind a lip extruding from a ledge. The end of the bracket may be bent into an arc, wherein the arc is retained behind a lip extruding from a ledge. The bracket may include a planar metal plate having a top edge and a bottom edge, wherein the top edge is retained in a first channel and the bottom edge is retained in a second channel.

The pocket may be comprised of a first component having a first engagement device and a second component having a second engagement device, wherein the first engagement device engages the second engagement device to form the pocket. The disassembled pocket may also be comprised of a first component nested into a second component to reduce space for shipping. The pocket may be comprised of a first component and a replaceable second component, wherein the second component may be replaced with a third component that results in a different width of the pocket. Moreover, the second component having a second bracket may be replaced with a third component having a third bracket.

The window shade fabric hangs down from the pocket and over a window or other object. The window shade should ideally lay flat without any wrinkling or shadowing on the surface of the window shade. The window shade is visible by occupants of the building and may be visible from outside of the building. As such, it may be important for a window shade to include a clean, crisp and even surface, while avoiding unsightly shadows on the window shade.

The window shade pocket system may also comprise a pocket having an inside surface, a first wall and a second wall, wherein a roller shade is mounted within the pocket; and a first bracket removably affixed to the inside surface of the first wall of the pocket, wherein the first bracket retains a light source. The light source may include at least one of a light bulb, light bar, light strip, LED lighting or reflective device. The light source may be LED lighting that is modular or provides different colors over the window shade fabric. The light source may include a lens. The light source may be at least one of removeable from the first bracket or rotatable within the first bracket. The light source may be at least one of between the window shade and the window, or between the room and the window shade.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

As set forth in more detail in the attached drawings, the present disclosure includes cabling and other components 110 (e.g., power plug, splitter, electrical components, etc.) in the window shade pocket 100. The window shade pocket 100 may be outside of the plenum and considered part of the room, and not part of the ceiling. However, the window shade pocket 100 may be in the plenum, but the pocket 100 may still be considered part of the room. By including the cabling and other components in the window shade pocket 100, the cabling may not need to meet the more restrictive and more expensive ceiling fire codes. As such, the less expensive non-plenum (e.g., PVC) cabling may be used in the pocket 100.

In various embodiments, the cabling and other components 110 may be incorporated into the window shade pocket 100 in any manner. In this manner, the pocket 100 combines the functionality of a mounting space (e.g., for roller shades) and wiring space. In various embodiments, the window shade pocket 100 may include one or more permanent or removable channel that retains the cables and/or other components 110. In various embodiments, the pocket 100 and/or brackets 105 may be comprised of aluminum or non-metallic material. In various embodiments, the pocket 100 and/or brackets 105 may also be modular to support various ceiling systems and attachments. In various embodiments, the brackets 105 may be continuous down all or a portion of the pocket 100 (as set forth in FIG. 6) or may be spaced periodically along the inside of the pocket 100 (as set forth in FIG. 7).

Figure 6:
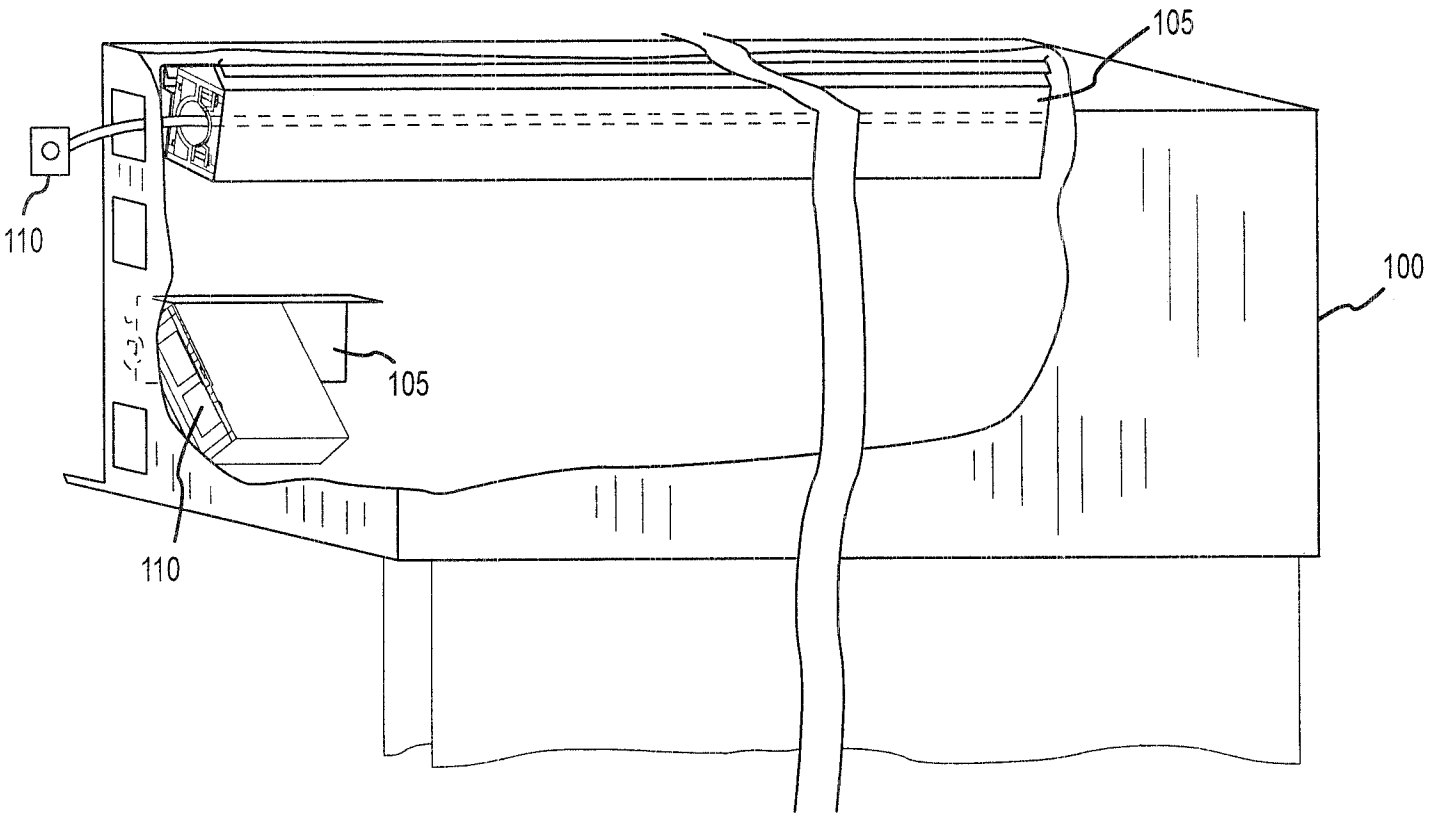
FIG. 6 is an exemplary diagram of a cut-away view of a window shade pocket showing a full first bracket, a second bracket and cabling, in accordance with various embodiments.
Figure 7:
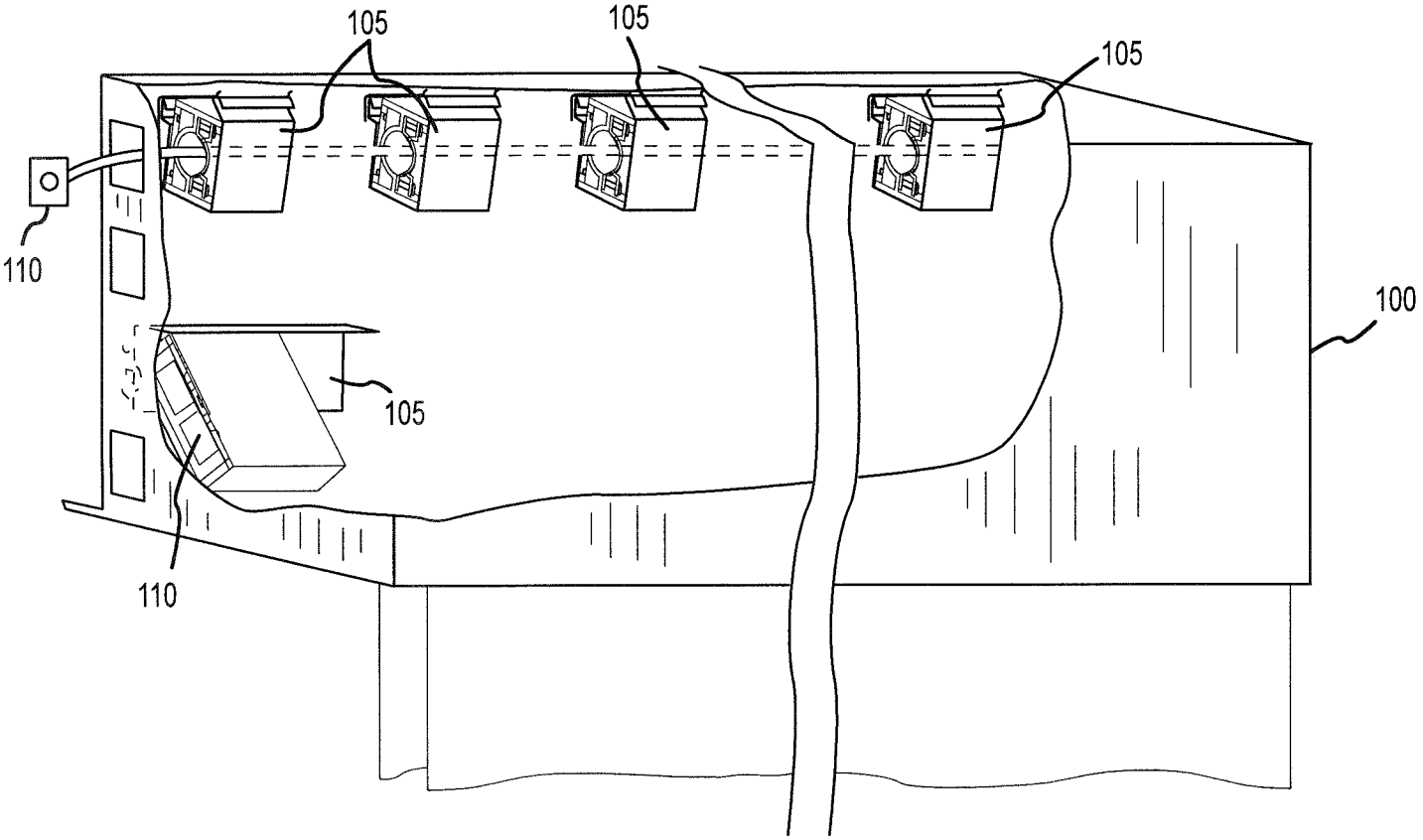
FIG. 7 is an exemplary diagram of a cut-away view of a window shade pocket showing a plurality of first brackets, a second bracket and cabling, in accordance with various embodiments.

In various embodiments, and as set forth in FIGS. 6-7, the cables may be held in the channels directly. Hooks, retaining clips and/or springs may allow access to the cabling. Clip-in-brackets 105 may be included to reduce weight and to reduce the cost of pocket 100. The clip-in-brackets 105 may be the entire length of the pocket 100, over a portion of the pocket 100 and/or multiple brackets 105 over specified separation mounting distances. The brackets 105 may mount on one or more of the faces of the pocket 100. The shade 115 may be removed (or more easily removed) after the retaining clip or channel is removed. The shade may also be removed around the bracket, while the bracket 105 is still installed.

The brackets 105 may be mounted to allow the roller shade to operate without impacting the bracket. The cabling may be serviced while protecting the cables from physical access or exposure to the rotating shade 115. In various embodiments, additional safety features may be incorporated into the system such as, for example, methods of separation of high and low voltage cabling to meet code (e.g., distance versus metal barrier). In various embodiments, the pocket 100 may be grounded and/or a junction box may be included in the pocket 100. In various embodiments, the pocket 100 may include venting options such as, for example, pre-punched holes and/or a removable back wall where a punched sheet can be inserted. Such venting features can even be added after installation. The hole sizes may be variable. The pocket 100 and brackets 105 may include features to prevent or minimize vibration for various attachments.

Figure 8:
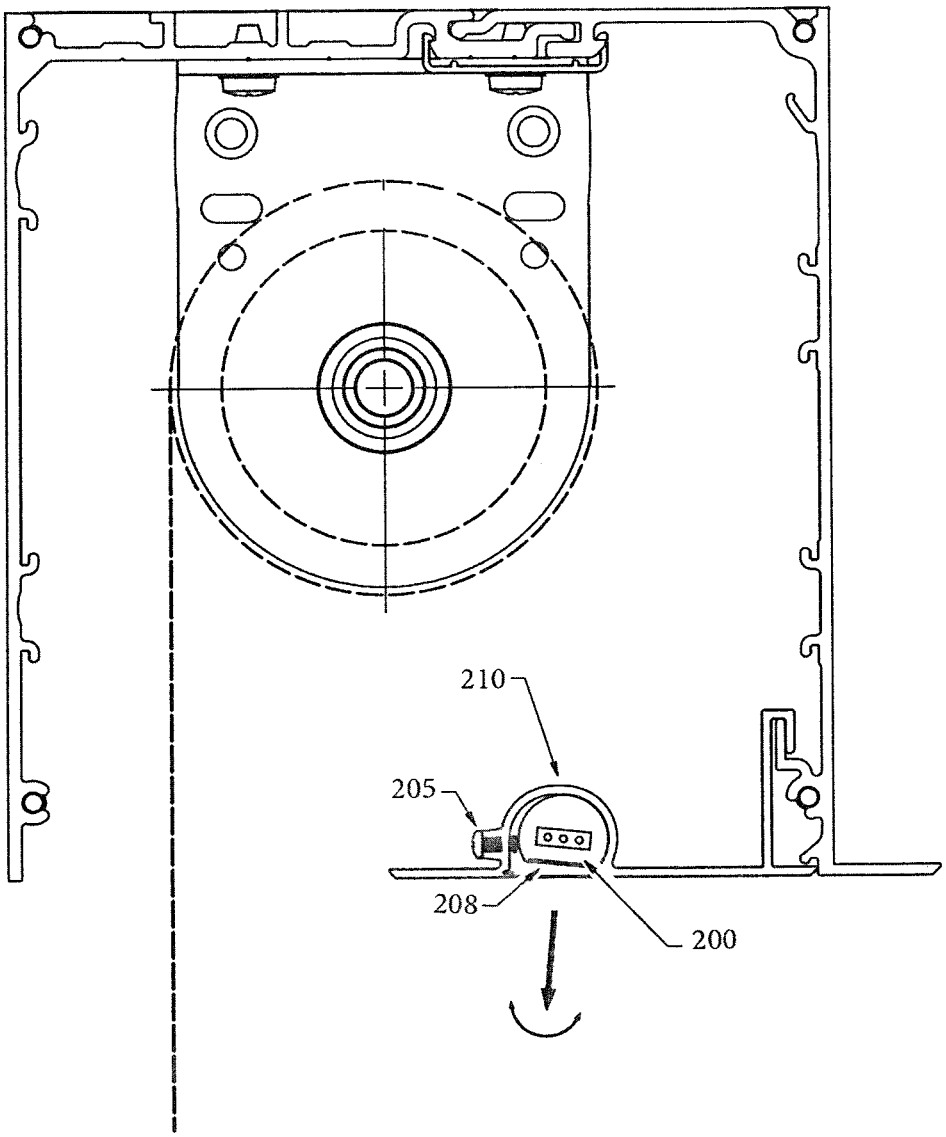
FIG. 8 is an exemplary diagram of a cut-away view of a window shade pocket showing a light source inserted into a bottom bracket attached to the pocket, in accordance with various embodiments.
Figure 9:
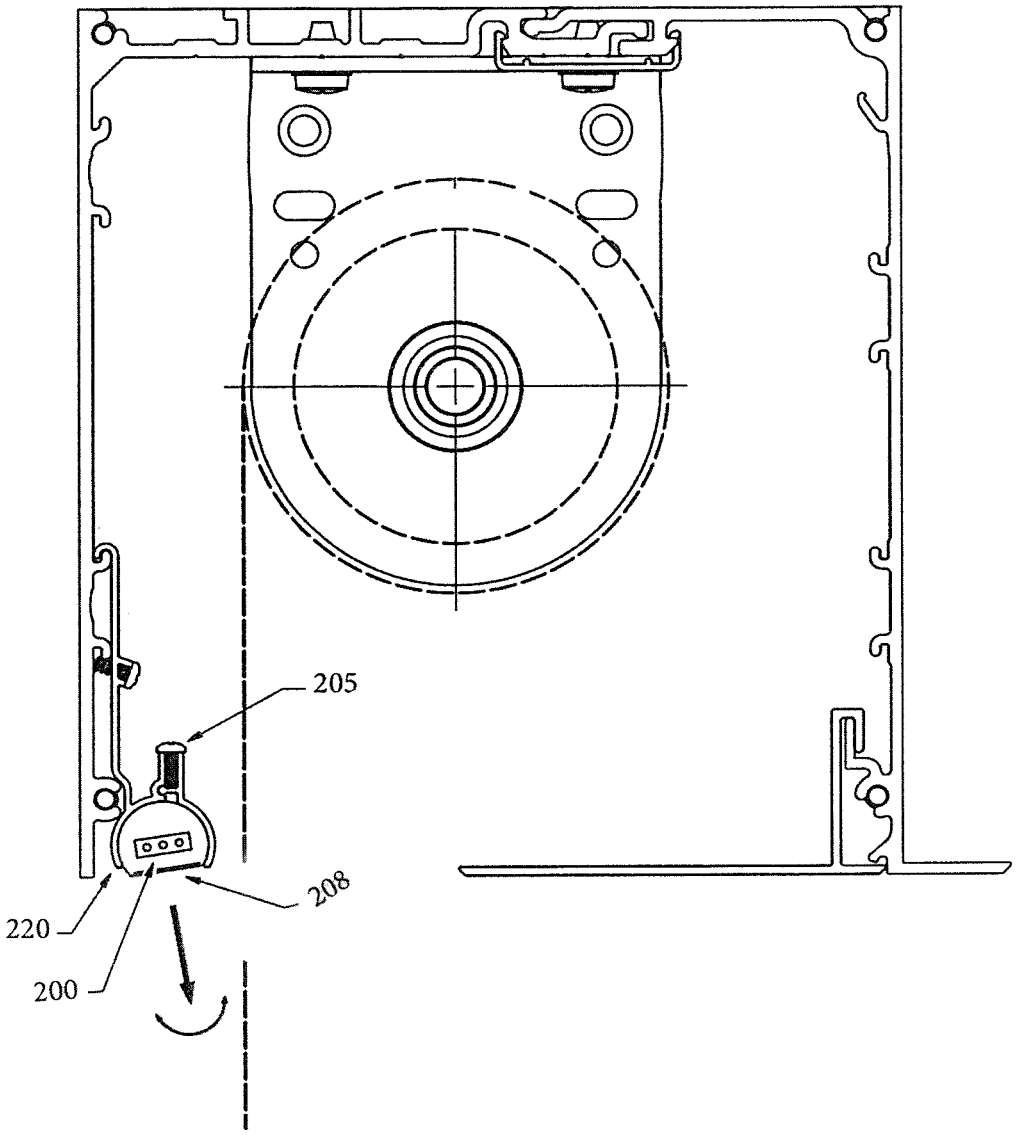
FIG. 9 is an exemplary diagram of a cut-away view of a window shade pocket showing a light source inserted into a side bracket attached to the pocket, in accordance with various embodiments.

More specifically, and in various embodiments, the window shade pocket 100 system may comprise a pocket 100 having an inside surface, a bracket 105 removably affixed to the inside surface of the pocket 100 and a roller shade 115 within the pocket 100. The inside surface of the pocket 100 may include a first wall 120, a second wall 125 and a third wall 130, wherein the third wall 130 includes the bracket 105 retaining the cabling. The bracket 105 may retain cabling and/or electrical components 110 within the bracket. The electrical components 110 may include a light source 200 and associated wiring, as shown in FIGS. 8 and 9. Bracket 105 may include a bracket 210 or 220, as shown in FIGS. 8 and 9, that is configured to retain light source 200. The bracket 105 may include a plurality of brackets 105 along the inside surface of the pocket 100, wherein the cabling is retained within the plurality of brackets 105. The bracket 105 may form a channel between the bracket 105 and the inside surface of the pocket 100. The roller shade 115 may be able to be removed after the bracket 105 is removed or the roller shade 115 may be able to be removed while the bracket 105 is still affixed to the inside surface of the pocket 100.

Figure 1:
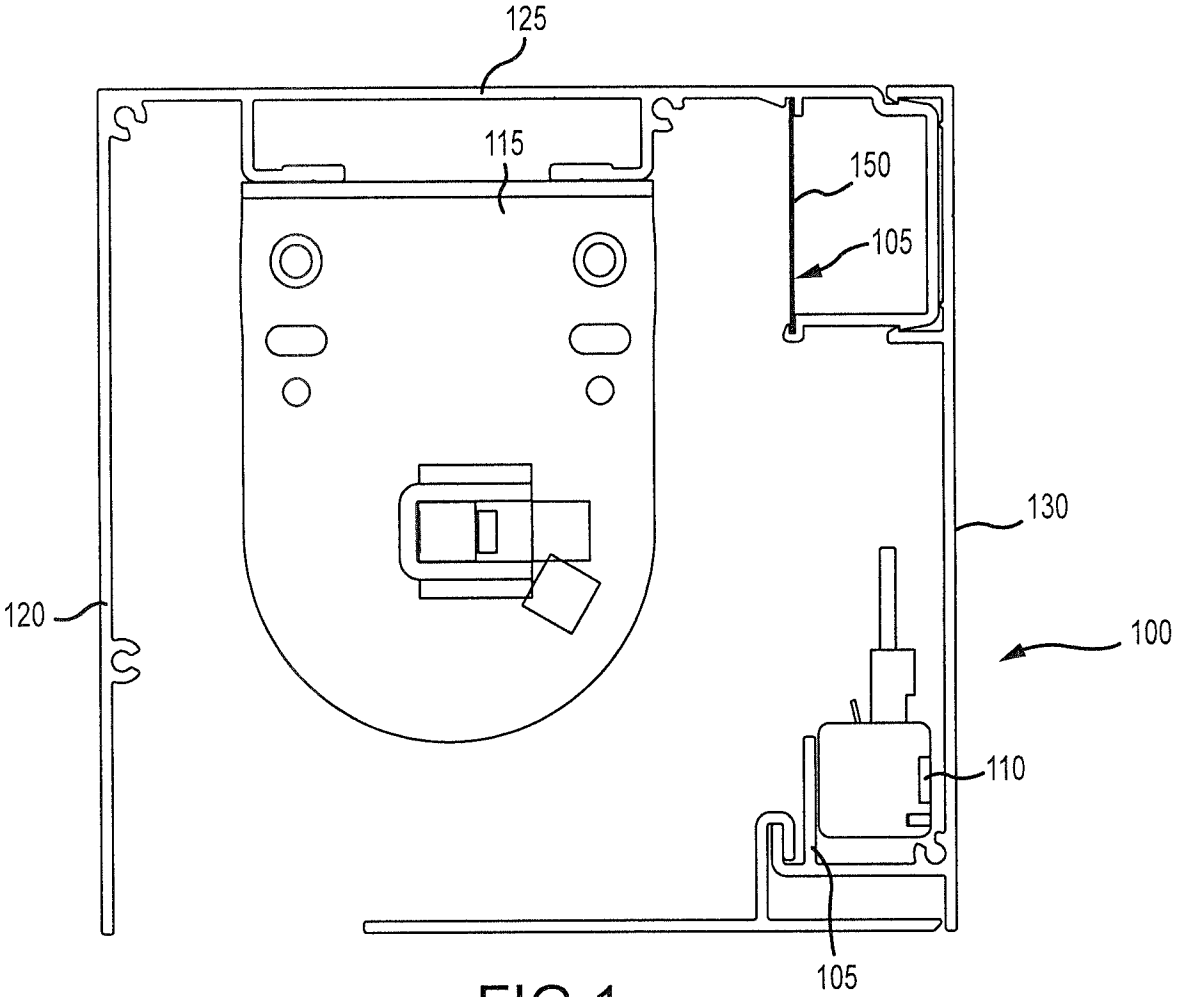
FIG. 1 is a schematic diagram of a window shade pocket with a roller shade and a planar bracket, in accordance with various embodiments.
Figure 2:
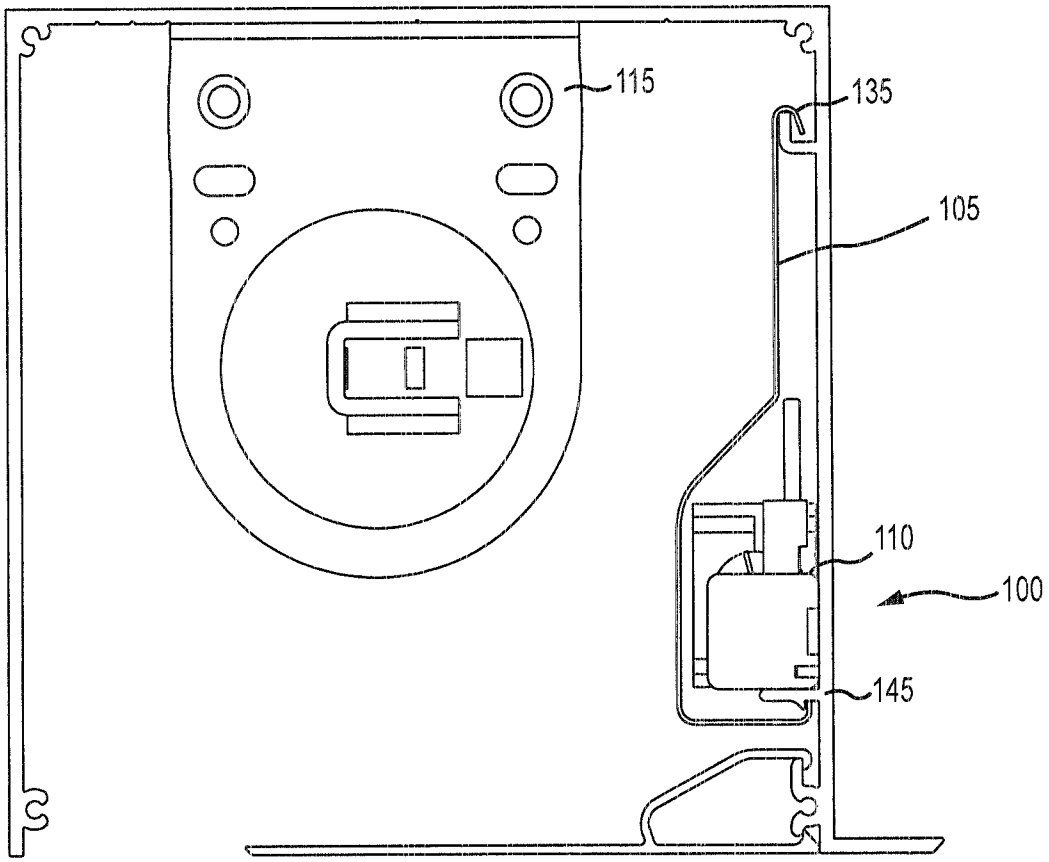
FIG. 2 is a schematic diagram of a window shade pocket with a roller shade and a bracket having a bent metal retaining clip, in accordance with various embodiments.
Figure 3:
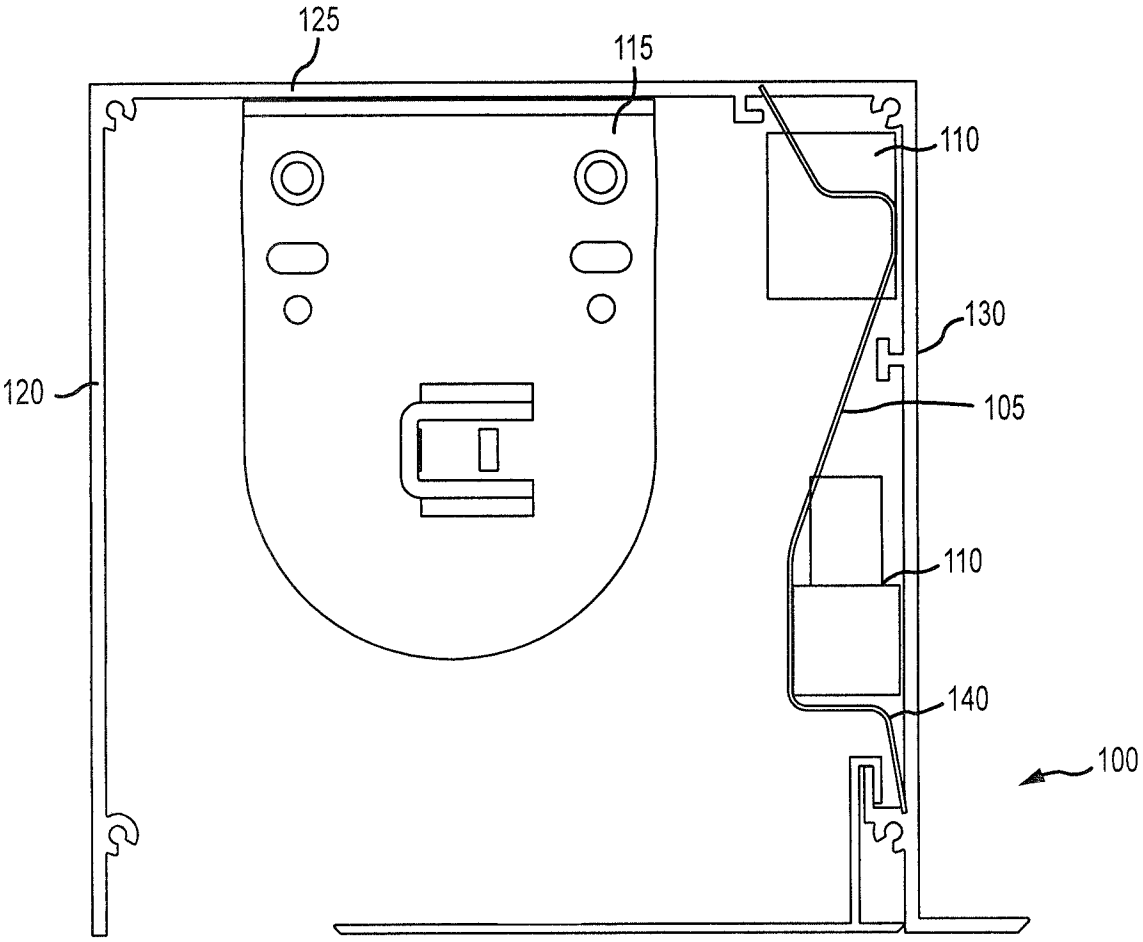
FIG. 3 is a schematic diagram of a window shade pocket with a roller shade and a bracket having a spring clip, in accordance with various embodiments.

In various embodiments, the bracket 105 may include a bent metal retaining clip 135 (as shown in FIG. 2) and/or a spring clip 140 (as shown in FIG. 3). The end of the bracket 105 may be retained behind a lip 145 (as shown in FIG. 2) extruding from a ledge. The end of the bracket 105 may be bent into an arc 135, wherein the arc is retained behind a lip extruding from a ledge. The bracket 105 may include a planar metal plate 150 (as shown in FIG. 1) having a top edge and a bottom edge, wherein the top edge is retained in a first channel and the bottom edge is retained in a second channel.

Figure 5:
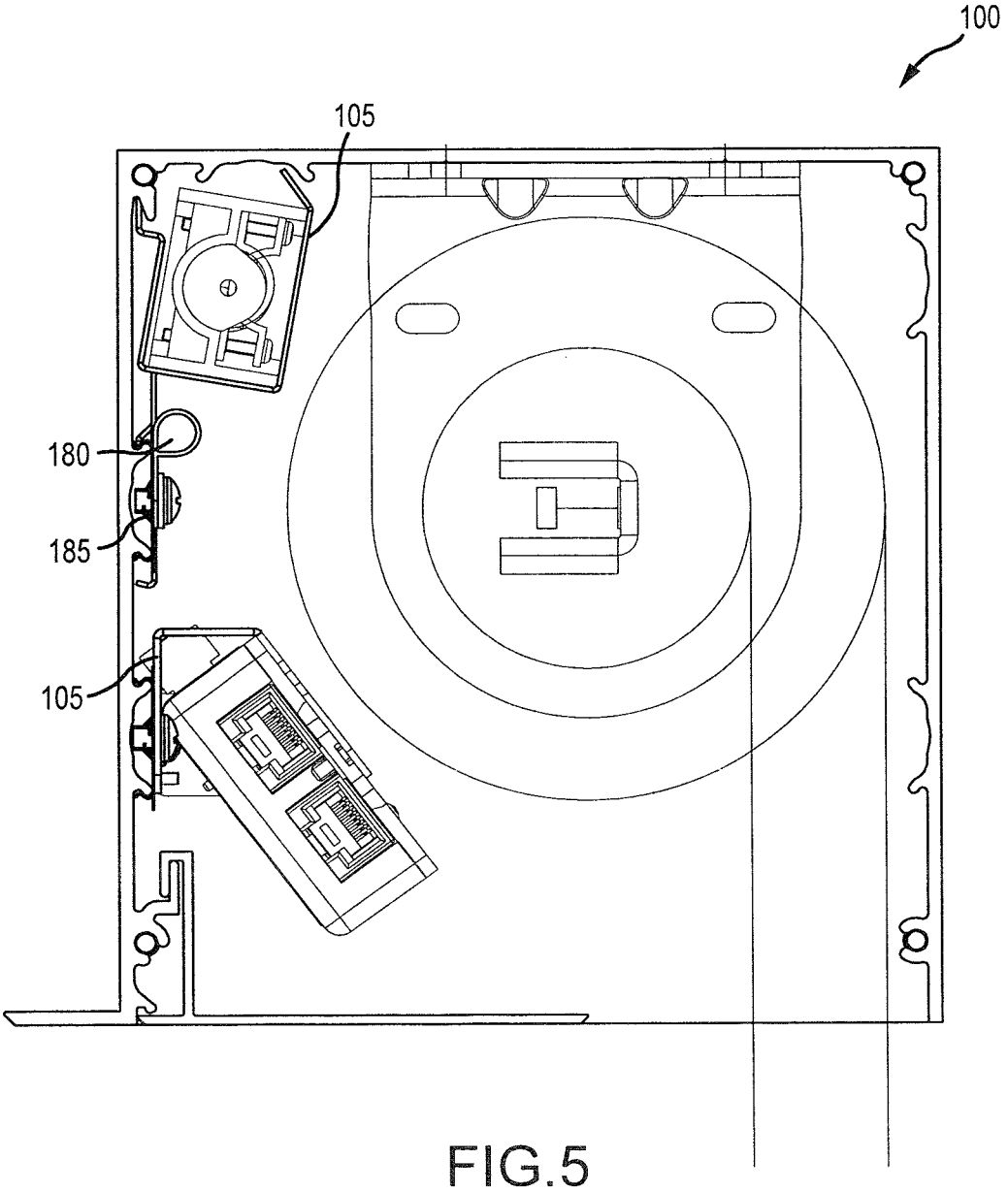
FIG. 5 is a schematic diagram of a window shade pocket with a roller shade and a additional bracket embodiments along with a cable clip, in accordance with various embodiments.

Additional bracket 105 embodiments are shown in FIG. 5 supporting different electronic components, but still avoiding contact with the roller shade. A cable clip 180 is also shown in FIG. 5. Cable clip 180 is configured to receive a cable and provide support for the cable, while keeping the cable close to the side wall of pocket 100. Cable clip 180 and/or bracket 105 may attach to the side wall of pocket 100 using, for example, miter angles 185. Miter angles 185 include curved ends that partially wrap around the lips protruding from the side wall. Upon tightening the fastener against the side wall, the curved ends tightly engage the lips protruding from the side wall, thereby securely fastening bracket 105 to the side wall of pocket 100.

Figure 4:
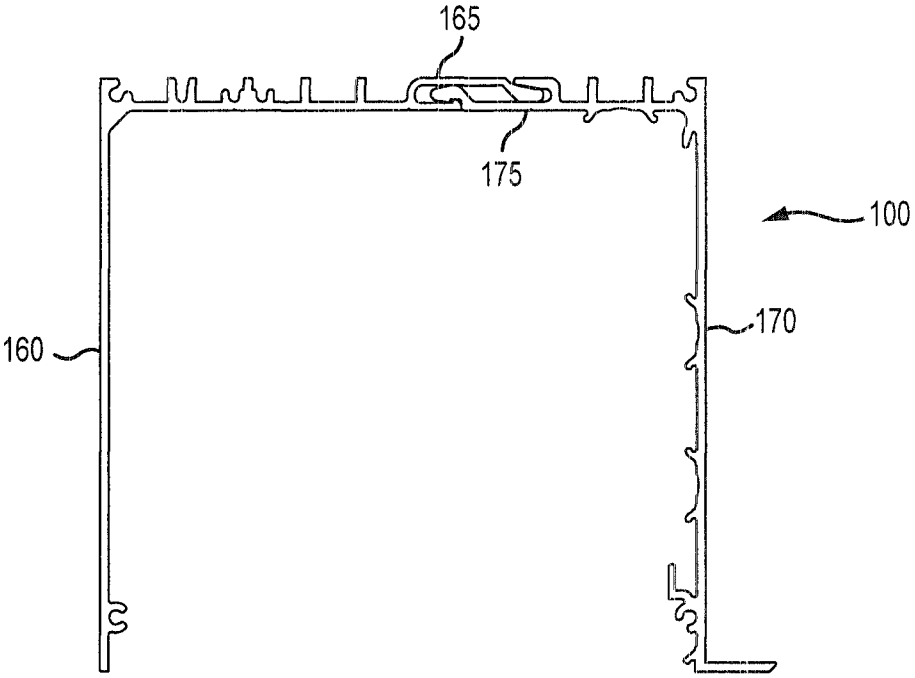
FIG. 4 is a schematic diagram of a window shade pocket showing the engagement device on the top wall, in accordance with various embodiments.

In various embodiments, and as shown in FIG. 4, the pocket 100 may be comprised of a first component 160 having a first engagement device 165 and a second component 170 having a second engagement device 175, wherein the first engagement device 165 engages the second engagement device 17 to form the pocket 100. Having the pocket 100 comprised of two components may allow for a smaller die to extrude the aluminum for each component. Moreover, having the pocket 100 comprised of two components provides the ability to have different widths assembled by only changing one of the components (extrusions). Having the pocket 100 comprised of two engaged components also provides the ability to have different features in the assembled pocket 100 by simply changing one of the extrusions. Furthermore, having the pocket 100 comprised of two engaged components also allows a design of the pocket 100 with thinner walls and thus makes the pocket 100 lighter and less expensive. However, having the pocket 100 comprised of two engaged components may not impact the brackets 105 and the electrical channels discussed herein because the engagement is on the top panel and not on the side panels where the brackets 105 may be inserted.

The disassembled pocket 100 may also be comprised of a first component 160 nested into a second component 170 to reduce space for shipping. The pocket 100 may be comprised of a first component and a replaceable second component, wherein the second component may be replaced with a third component (e.g., of a different size) that results in a different width of the pocket 100. Moreover, the second component 170 having a second bracket 105 may be replaced with a third component having a third bracket 105.

As briefly discussed above, bracket 105 may retain cabling and/or electrical components 110 within bracket 105. In various embodiments, the electrical components 110 may include a light source 200, as shown in FIGS. 8-11. The pocket may also include wiring or other components that support or are part of the light source. Bracket 105 may include a bracket 210, 220 or 230, as shown in FIGS. 8, 9 and 11 respectively, that is configured to retain light source 200. The light source may include, for example, any type of light bulb, light bar, light strip (e.g. LED lighting), reflective device (e.g., mirror) and/or the like. An example of a light strip includes TSV16.4 Feet 300 Led RGB Muliticolor Changing RGB Led TV Backlight Strip Light Kit Sold By Wow Parts or the Monster Illumination Sound-Light Led 65" RGB Multicolor Changing Mood And Music Mode Light Strip sold by Monster. In various embodiments, the LED strips may be modular and extendable.

The lighting strips may connect via 2 or more pinholes on the end of the lighting strip for power. The lighting strips may also employ cable connectors. In various embodiments, the lighting strips may connect together with more connections when intelligent to accommodate both power and a network. For example, channel access may exist from the pocket area to the lighting strip. Such a configuration helps to ensure that the connection from the pocket wiring to the first lighting strip can be completed without having to machine the channel (or with minimal machining). The network could be POE (power over ethernet) which may power and network the light strip over a single cable or multi-pin connector. The network may also include wireless radio frequency to minimize cabling. Power may also be battery powered inside the pocket or inside the light strip. Via a network connection, the light source may be controlled and automated relative to on/off, dim level, frequency and/or color. Automation may be accomplished based on schedule, sunrise/sunset, ambient light level outside the building, ambient light level inside the building, occupancy, shade position, sky condition and/or circadian rhythm optimization for the occupant(s). When coupled together, the connected modular light sections may rotate together. When the light source is intelligent, the coupled sections may all illuminate the same, or if networked, the coupled sections may illuminate based on zone requirements.

In various embodiments, the bracket may be configured as an attachment to the pocket or to an enclosure, wherein the attachment is configured to receive the light source. The attachment 210, 220 or 230 may include an enclosure for the light source, such that the light source may be removed from the enclosure (e.g., to replace the bulb) and/or rotate within the enclosure (e.g., to point the light closer to the window shade). The system may include an interlock for a screw 205 (or a device with similar functionality) to affix the angular rotation of the light source. In various embodiments, this interlock may be positioned on the exterior surface of the pocket with the adjustment surface facing down in order to promote easy access to adjust the angle. Access to the adjustment may be hidden behind a decorative cover to help minimize view of such less aesthetic features from the room.

Figure 10:
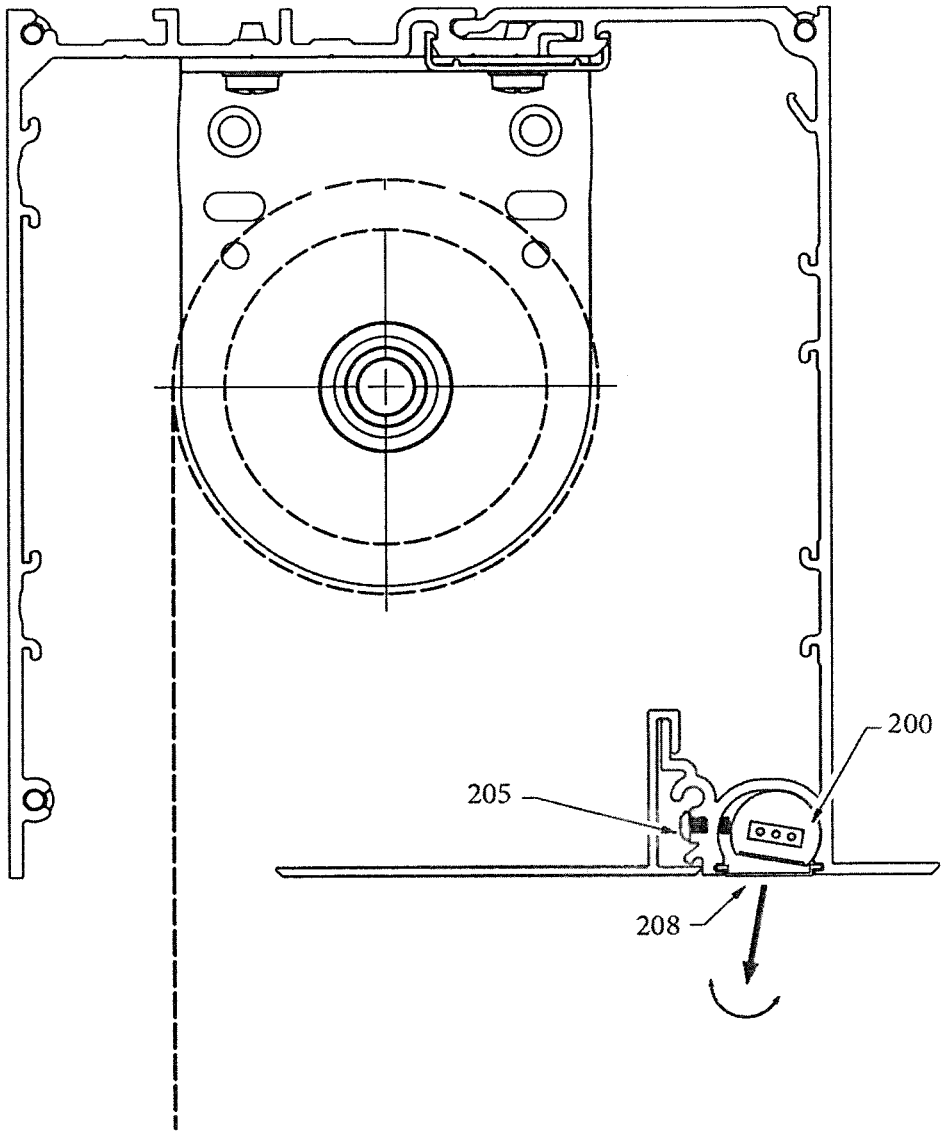
FIG. 10 is an exemplary diagram of a cut-away view of a window shade pocket showing a light source inserted into the bottom of the pocket, in accordance with various embodiments.
Figure 11:
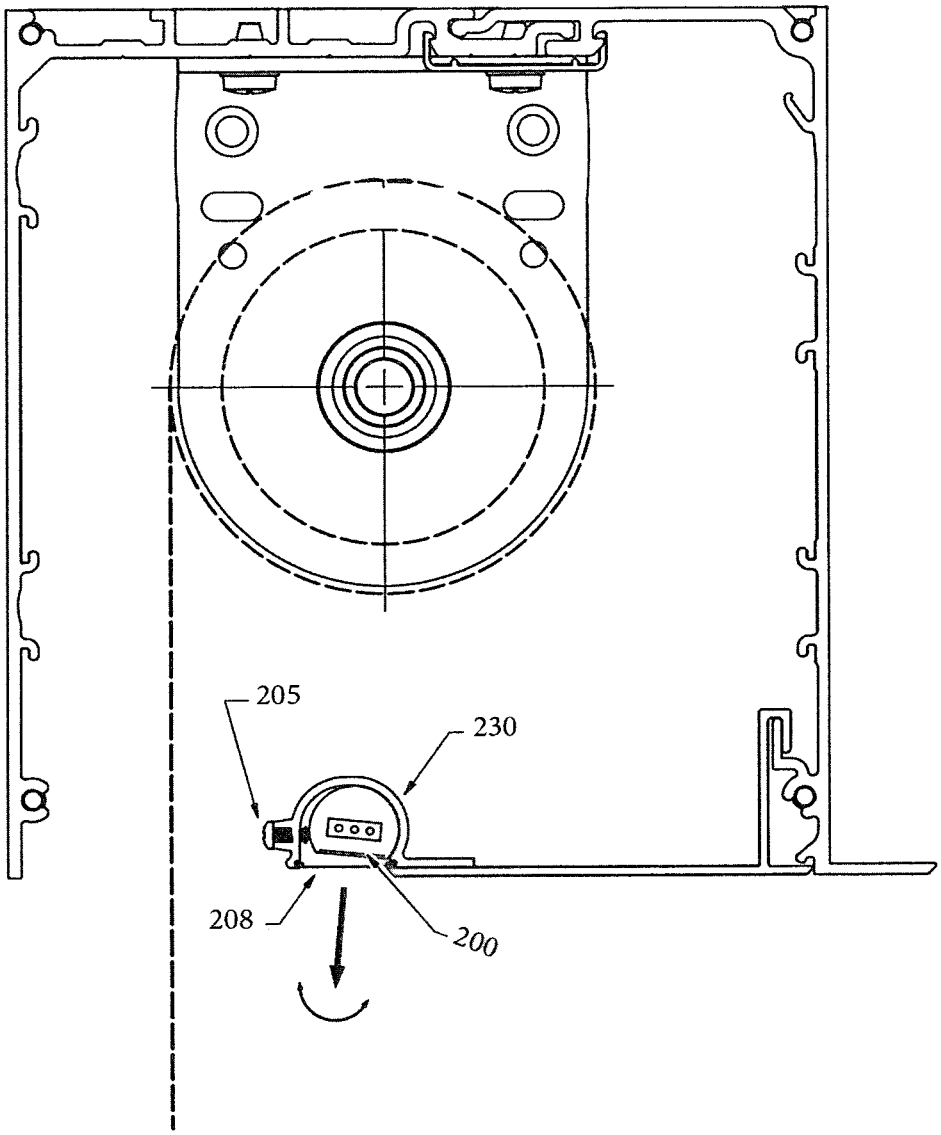
FIG. 11 is an exemplary diagram of a cut-away view of a window shade pocket showing a light source inserted into a bottom bracket attached to the end of an enclosure, wherein the enclosure is attached to the pocket, in accordance with various embodiments.

As set forth in FIG. 10, the light source may fit into a portion of the pocket (e.g., bottom portion). Because the pocket is stationary, the system includes a flexible mount to pop the light strip straight up and into the channel in the pocket from below. The light strip may also be slid into the channel. In various embodiments, when the LED strip section is installed into the pocket, and the wiring is not in the removable closure portion (covering a portion of the open bottom of the pocket) because the closure portion may not need to include any wiring. Moreover, the closure portion may be removed or installed without impacting the light source.

As set forth in FIG. 8, the attachment may attach to the pocket (e.g., attach to the side of the pocket), but extend horizontally outward and allow the light source 200 to shine downward, with different embodiments shown in each figure. As set forth in FIG. 11, the attachment may attach to the enclosure, wherein the enclosure attaches to the pocket. These configurations may allow lighting the shade from the interior of the room. As set forth in FIG. 9, the attachment may attach to a side surface of the pocket. This configuration may light the shade from the window direction. The attachment may include one or more interlocking fingers to temporarily secure the attachment to the pocket wall. A light strip or light bar may slide into a groove in the bracket or in the pocket wall. Different attachment configurations and/or locations may allow the light source to be closer or farther from the fabric surface.

In various embodiments, the light source may be in front of and/or behind the window shade fabric. The light source may light the shade in order to promote a certain decorative cosmetic, or the lighting of the shade may serve functional purpose within the room. Window shade fabric may have a certain openness factor or it may be a solid, blackout material. The openness factor may allow someone from the outside of a building to partially or fully see through the fabric and into the building, particularly when a room is lit up inside the building at night. Privacy and restricted viewing through the shade may be achieved by having a light source brighten the shade from the side of the viewer.

When lighting the shade from the interior and/or exterior, the light source may also include different colors to adjust the color of the window shade. Such color change may impact (e.g., benefit) the tone of the room, or the circadian rhythm of its occupants. The color changes may be dependent upon the time of day, season of the year, current sky conditions, holidays, temperature, working conditions, activities around the window shades (e.g., party, work-out, work), etc.

In various embodiments, the system may minimize or avoid shadows on the window shade fabric. For example, the system may be configured to include the light bar farther away from the fabric to minimize light shadows on the fabric. If the fabric has wrinkles or does not hang down with a smooth surface, the light may cause unsightly shadows on the fabric. The use of the light source on the fabric surface may reduce or eliminate such unsightly shadows on the window shade fabric. The light source may also reduce or eliminate hot spots on the window shade fabric.

In various embodiments, the system may include a lens (or lens cover) 208 over the light source. Any type, color or configuration of lens 208 may be included in the system. The lens 208 may focus or broaden a beam from the light source to change the light beam's impact on the window shade fabric's surface. The lens 208 may be over the light source and snap into the attachment device or in the pocket wall. The lens 208 may be configured to focus the light from the light source over the window shade fabric. The lens 208 may focus the light over a certain portion of the fabric, evenly over the entire fabric, evenly over the portion of the fabric that covers a certain area (e.g. the portion that covers the window), away from the fabric or any other distribution of light. The lens 208 may include textures and/or films to help diffuse the light. The lens 208 may be tinted in order to help control the color of the light. Some light sources (e.g. LEDs) may be tunable in color and/or spectrum, so tinted lenses may not be required.

The lens (or lens cover) 208 may be configured in various ways. The lens 208 may be built into the housing of the lighting strip. The lens 208 may be attached to the lighting strip. The lens 208 may rotate independent of the LED which helps minimize wiring from affecting the ease of rotation. The lens 208 may also be changed onsite to optimize to field conditions (allows more flexibility on site).

The detailed description of exemplary embodiments herein makes reference to the accompanying drawings, which show exemplary embodiments by way of illustration and its best mode, and not of limitation. While these exemplary embodiments are described in sufficient detail to enable those skilled in the art to practice the invention, it should be understood that other embodiments may be realized and that logical, chemical and mechanical changes may be made without departing from the spirit and scope of the invention. For example, the steps recited in any of the method or process descriptions may be executed in any order and are not necessarily limited to the order presented. Moreover, many of the functions or steps may be outsourced to or performed by one or more third parties. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Systems and methods are provided. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A window shade pocket system comprising:

a pocket having a first wall and a second wall;

a window shade having a first side and a second side, wherein the window shade is mounted within the pocket and is configured to at least partially extend over a window outside of the pocket; and a first bracket removably affixed to at least one of a closure extending from the first wall, the first wall or the second wall, wherein the first bracket retains a light source, and wherein the light source is configured to illuminate at least a portion of at least one of the first side or the second side of the window shade outside of the pocket.

2. The window shade pocket system of claim 1, wherein the light source includes at least one of a light bulb, light bar, light strip, LED lighting or reflective device.

3. The window shade pocket system of claim 1, wherein the light source is modular LED lighting.

4. The window shade pocket system of claim 1, wherein the light source is LED lighting that provides different colors over the window shade.

5. The window shade pocket system of claim 1, wherein the light source includes a lens.

6. The window shade pocket system of claim 1, wherein the light source is at least one of removeable from the first bracket or rotatable within the first bracket.

7. The window shade pocket system of claim 1, wherein the light source is at least one of between the window shade and the window, or between a room and the window shade.

8. The window shade pocket system of claim 1, wherein the light source includes a lens, wherein the lens is configured to at least one of focus or broaden a light beam from the light source onto the window shade.

9. The window shade pocket system of claim 1, wherein the light source is connected by at least one of a battery, power over ethernet, wireless radio frequency, a multi-pin connector or cable connector.

10. The window shade pocket system of claim 1, wherein the light source includes a network connection.

11. The window shade pocket system of claim 1, wherein the pocket includes a length extending from a first end of the pocket to a second end of the pocket, and wherein the first bracket extends along the length of the pocket from the first end of the pocket to the second end of the pocket.

12. The window shade pocket system of claim 1, wherein the first bracket includes at least one of a cable clip, metal retaining clip with a bent end or a spring clip wherein an end of the spring clip is bent behind a lip.

13. The window shade pocket system of claim 1, wherein the light source includes a network connection such that the light source is controlled and automated for at least one of activating, deactivating, dim level, frequency or color.

14. The window shade pocket system of claim 1, wherein the window shade is able to be removed after the first bracket is removed.

15. The window shade pocket system of claim 1, wherein the light source is located in a bottom closure portion of the pocket such that the light source is configured to be at least one of installed, removed or changed from below the pocket.

16. The window shade pocket system of claim 1, wherein an enclosure includes an interlock that is configured to affix an angular rotation of the light source within the enclosure.

17. The window shade pocket system of claim 16, wherein the interlock is configured to be accessible from an outside of the pocket.

18. The window shade pocket system of claim 1, wherein the light source is automated based on at least one of schedule, sunrise, sunset, ambient light level outside a building, ambient light level inside the building, occupancy, position of the window shade, sky condition or circadian rhythm optimization for an occupant of the building.

19. The window shade pocket system of claim 1, wherein the light source includes coupled sections that at least one of illuminate together or illuminate in zones.

20. The window shade pocket system of claim 1, wherein the light source is configured to rotate within an enclosure that interfaces with the first bracket.

* * * * *